US007165931B2

(12) United States Patent
Olivier et al.

(10) Patent No.: US 7,165,931 B2
(45) Date of Patent: Jan. 23, 2007

(54) COMPACT MOLECULAR-DRAG VACUUM PUMP

(75) Inventors: Marc Olivier, Sandy, UT (US); Stephen C. Jacobsen, Salt Lake City, UT (US); David Knutti, Taylorsville, UT (US)

(73) Assignee: Sarcos Investments LC, Salt Lake City, UT (US)

( * ) Notice: Subject to any disclaimer, the term of this patent is extended or adjusted under 35 U.S.C. 154(b) by 185 days.

(21) Appl. No.: 11/028,998

(22) Filed: Jan. 3, 2005

(65) Prior Publication Data

US 2005/0118014 A1 Jun. 2, 2005

Related U.S. Application Data

(60) Division of application No. 10/246,798, filed on Sep. 17, 2002, now Pat. No. 6,866,488, which is a continuation-in-part of application No. 09/419,959, filed on Oct. 18, 1999, now Pat. No. 6,450,772.

(51) Int. Cl.
*F01D 1/36* (2006.01)
*F03B 5/00* (2006.01)

(52) U.S. Cl. ..... 415/55.2; 415/90; 415/55.4; 415/55.5; 415/174.4

(58) Field of Classification Search ..... 415/55.2, 415/55.3, 55.4, 55.6, 90, 173.4, 173.5, 174.4, 415/174.5
See application file for complete search history.

(56) References Cited

U.S. PATENT DOCUMENTS 3,969,042 A 7/1976 Bachler
5,160,250 A 11/1992 Ikegami et al.
5,354,172 A 10/1994 Schofield (Continued)

FOREIGN PATENT DOCUMENTS

DE 3919529 1/1990
JP 57-62995 A 4/1982
JP 61-85599 A 5/1986

OTHER PUBLICATIONS

Levi "Vacuum Performance of Molecular Drag Stages" Vacuum, vol. 43, Nos. 5-7 pp. 541-543 (1992).

(Continued)

*Primary Examiner*—Edward K. Look
*Assistant Examiner*—Dwayne J White
(74) *Attorney, Agent, or Firm*—Thorpe North & Western LLP

(57) ABSTRACT

A molecular drag vacuum pump configured for pumping a gas stream from an inlet to an outlet, the pump including a high-speed spinning disk or rotor disposed within a housing. A passageway is formed inside the housing adjacent the disk, and gas comes in contact with surfaces of the spinning disk in successive stages, conformable wipers being disposed adjacent the spinning disk to direct the gas stream to the successive stages. The disk can be powered by an integrated motor, comprising permanent magnets associated with the disk and cooperating coils associated with the housing. The wipers can include parallel ridges on a contacting face to facilitate creation of a conformable fit with the rotor. Seal rings may be disposed against the disk between gas passageways to reduce leakage therebetween, and the pump may include regenerative pumping pockets to help prevent backflow. The housing may have a modular configuration to allow two or more pump modules to be connected and operate in series. Successive stages may be independently or commonly powered, and may counter-rotate.

21 Claims, 7 Drawing Sheets

U.S. PATENT DOCUMENTS

| | | | |
|---|---|---|---|
| 5,456,575 | A | 10/1995 | Helmer et al. |
| 5,482,430 | A | 1/1996 | Hablanian |
| 5,709,528 | A | 1/1998 | Hablanian |

OTHER PUBLICATIONS

Panos et al., "The Helicoid Multi-groove Vacuum Pump in both Viscous an Molecular States", Vacuum, vol. 45, Nos. 8 pp. 841-847 (1994).

COMPACT MOLECULAR-DRAG VACUUM PUMP

The present application is a Division of U.S. patent application Ser. No. 10/246,798, filed on Sep. 17, 2002, now U.S. Pat. No. 6,866,488, which is a Continuation-In-Part of U.S. patent application Ser. No. 09/419,959, filed on Oct. 18, 1999 and entitled COMPACT MOLECULAR DRAG VACUUM PUMP, and subsequently issued as U.S. Pat. No. 6,450,772 on Sep. 17, 2002.

BACKGROUND OF THE INVENTION

1. Field of the Invention

This invention relates to a molecular-drag vacuum pump. More particularly, the invention relates to a compact, portable, molecular-drag vacuum pump.

2. State of the Art

In recent years, smaller and more portable chemical and biological sensors have been developed. These sensors have many potential applications, such as in hand-held chemical analyzers, biological detection systems, and other portable sensory instruments. Such instruments may find advantageous use, for example, by soldiers or others to detect the presence of chemical and biological warfare agents; or by inspectors as a simple and rapid means of on-site testing of environmental contaminants; or by law-enforcement personnel testing unknown substances found at a particular location.

However, to fully realize the benefit of these new smaller and more portable sensor systems, relatively compact, low-power vacuum pumps are desirable. Conventional vacuum pumps capable of achieving the desired pumping characteristics are typically too large, and consume too much power, for compatibility with portable sensor systems. Similarly, conventional pumps that are small enough for such applications generally cannot provide the high vacuum typically required for highly accurate sensing and testing of substances at low concentrations. Such conventional pumps are generally ineffective in the Knudsen range, where the concentration of remaining gas molecules is too small for the pump to operate effectively, and yet is the vacuum level where many sensors' effectiveness is enhanced by its provision. Several other solutions to the problem of getting higher vacuum in a small device have been tried, including using cryogenics, absorption of remaining gas molecules by some means, and diaphragm pumps, but, to applicant's knowledge, these have not provided a satisfactory vacuum from a small-enough device. The molecular-drag pump is promising for application in this area.

The concept of the molecular-drag pump was first introduced early in the $20^{th}$ century, see, e.g. W. Gaede, Annals of Physics, vol. 41, 337 (1913), and was later applied in a disk-shaped version see, e.g. M. Siegbahn, Archives of Mathematics, Astronomy, and Physics, vol. B30, 2 (1944). The basic principle of operation of the molecular-drag pump is to transfer momentum from a high-speed moving surface, such as a rotating rotor, disk or drum, to molecules of a gas, to thereby compress and direct the gas toward an outlet port. One or more wipers are provided to sweep molecules from the rotor toward the outlet, or toward another portion of the rotor in a multi-stage pump, as set forth below. Drag interaction between the moving surface and the gas causes the average kinetic energy of the gas molecules to increase along a pumping path through the pump in contact with the moving surface in a pumping direction; and imparts a net momentum toward the outlet along the path, making the gas as a whole more prone to evacuate the pump through the outlet. In a very low pressure range, this type of pump action causes a larger number of molecules to evacuate a space than other pump types, resulting in a more complete vacuum.

Some pumps of this type have more than one stage. The pumping path contacts a plurality of rotors sequentially, or contacts the same rotor sequentially at a plurality of places. A housing, and/or a housing in combination with wipers, conventionally re-directs the gas molecules sequentially to different locations, or stages, in a multi-stage pump.

Some Design goals regarding small molecular-drag pumps are to make efficient use of the space available for pumping, and to minimize power losses in bearings, in order to achieve a desired performance. In addition, in conventional molecular-drag pumps, the performance can be greatly effected by the tolerance between a wiper and a spinning rotor. Toward these goals, it would be desirable to have a compact molecular-drag pump that eases the fabrication tolerances of the pump parts, yet provides the desired performance. It would also be desirable to have a compact molecular-drag pump that makes use of efficient compact bearings. It is also desirable to have a compact molecular drag pump which compresses the gas in a series of stages in order to sequentially increase the pressure. Finally, it would be desirable to have a multiple-stage molecular-drag pump which accommodates a leakage between pumping stages by directing leakage gas from a later stage into a prior stage to combine with the incoming stream from the prior stage in a pumping direction along the pumping path back into the later stage.

SUMMARY OF THE INVENTION

The invention advantageously provides a molecular drag vacuum pump configured for pumping a gas stream from an inlet to an outlet, the pump including a high-speed spinning disk or rotor disposed within a housing. A plurality of passageways are formed inside the housing adjacent the disk, and gas is compressed by contact with surfaces of the spinning disk in successive stages. Conformable wipers are disposed adjacent the spinning disk to direct the gas stream to the successive stages.

In accordance with one aspect of the invention, the disk is powered by an integrated slotless, brushless, permanent magnet motor, comprising permanent magnets disposed in the disk, and cooperating coils in the housing. The magnets are arranged to emulate a two-pole pair permanent magnet. An external circuit electronically controls switching in the coils to power the rotation of the rotor.

In accordance with another more detailed aspect of the invention, soft ferrite rings are disposed adjacent the coils to provide a flux return path. The flux return path increases the field density adjacent the permanent magnets so as to enhance torque, and the soft ferrite material provides a relatively high resistivity so as to minimize eddy current-related power losses.

In accordance with yet another more detailed aspect of the invention, the wipers are provided with parallel ridges on a contacting face, to facilitate creation of a conformable fit with the rotor.

In accordance with another more detailed aspect of the invention, seal rings may be disposed against the disk between gas passageways to reduce leakage therebetween.

In accordance with still another more detailed aspect of the invention, the pump may include regenerative pumping pockets to help prevent backflow on the high pressure end of the pump.

In accordance with yet another more detailed aspect of the invention, the housing may have a modular configuration to allow two or more pump modules to be connected and operate in series. Successive stages may be independently or commonly powered, and may counter-rotate.

Other advantages and features of the present invention will be apparent to those skilled in the art from the following description, taken in combination with the accompanying drawings, which are given by way of examples, and not by way of limitation.

DETAILED DESCRIPTION

Reference will now be made to the drawings in which the various elements of exemplary embodiments will be given numeral designations and discussed. It is to be understood that the following description is only exemplary of the principles of the present invention, and should not be viewed as narrowing the scope of the invention set forth in the claims.

Figure 1:
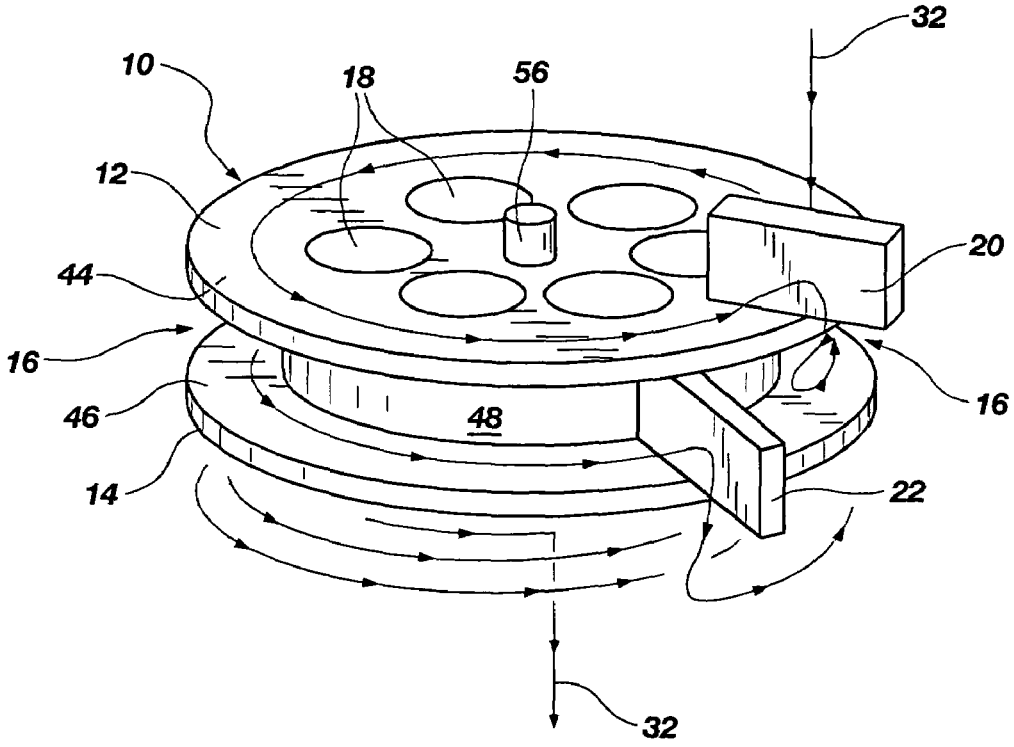
FIG. 1 is a schematic top-front perspective view of the rotor, wipers and gas flow path associated with a molecular-drag vacuum pump in one embodiment of the invention, the housing and other structure is not shown for clarity of presentation of the foregoing.
Figure 13:
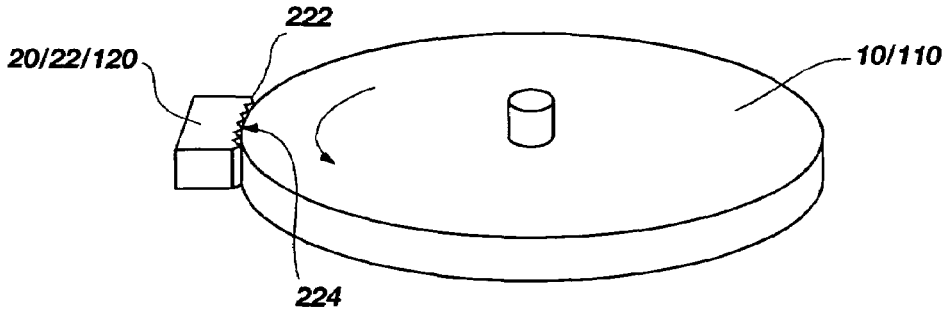
FIG. 13 is a pictorial view of a rotor having a wiper with ridges or corrugations on its contacting surface.

FIG. 1 provides a pictorial view of a rotor 10 and gas flow path 32 associated with a molecular-drag pump in one embodiment. The pump generally comprises a rotor 10 which is configured to rotate at very high speeds of between 100,000 and 200,000 rpm. For clarity, the rotor only is shown in FIG. 1 without a housing therearound. Details of the housing structure will be given hereafter. The rotor is shaped as a circular disk having a top surface 12, a bottom surface 14, and a channel 16 formed around its perimeter. Alternatively, as depicted in FIG. 13, the rotor may be configured with a straight side edge, without the perimeter channel 16. The thickness of the disk and the size of the channel 16 as shown in FIG. 1 is greatly exaggerated for purposes of clarity. The channel 16 is rectangular in cross-section, having a top surface 44, a bottom surface 46, and a back surface 48. The rotor can be made of a suitable rigid, lightweight material, such as aluminum, and in one embodiment is about 4 cm in diameter, and just over 5 mm thick, with the channel 16 being just under 5 mm wide and 3 mm deep.

A series of permanent magnets 18 are disposed in a circle about a center axis of the rotor 10. They are integral with the rotor, being embedded therein, and intersect the top surface 12, and/or the bottom surface 14 (not visible in FIG. 1). The permanent magnets 18 comprise a part of the motor drive system of the molecular-drag pump, which is described in more detail below. A rotor shaft 56 is disposed in the center of the rotor 10, and serves to carry the rotor and provides for rotation about the center axis, cooperating with bearings carried by the housing, as described in more detail below.

Abutting the top surface 12 of the rotor 10 is a first wiper plate 20 which directs the flow from a first passageway located above and adjacent to top surface 12 of the rotor, into a second passageway enclosed within channel 16, as will be described in more detail below. Disposed within the channel 16 and abutting the top surface 44, bottom surface 46, and back surface 48 of the channel 16 is a second wiper plate 22 which directs the flow from the second passageway (in channel 16) into a third passageway located below and adjacent to the bottom surface 14 of the rotor.

Figure 2:
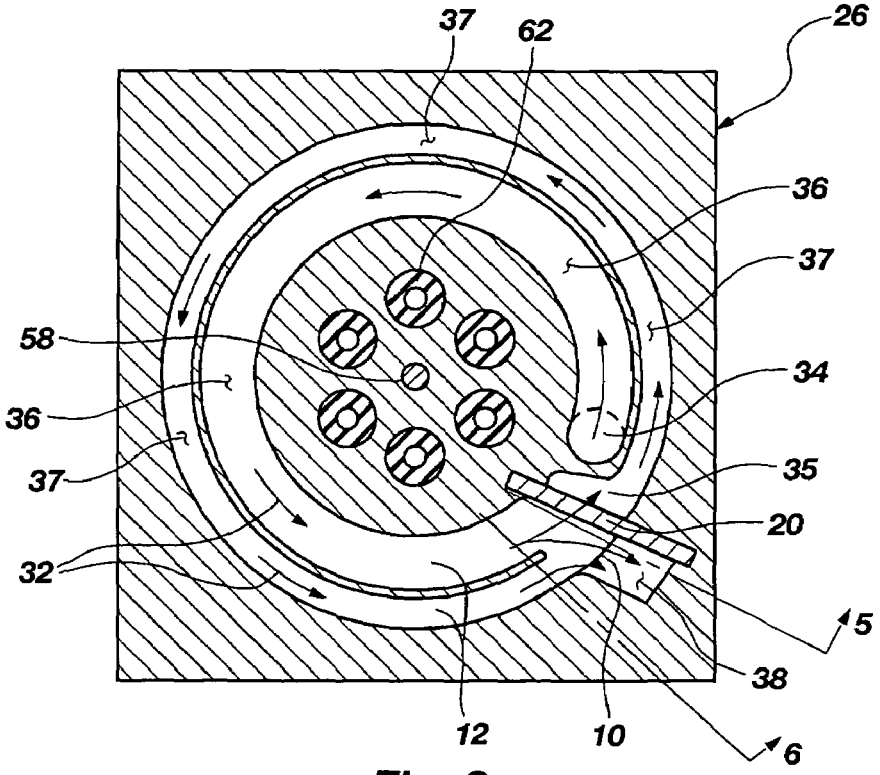
FIG. 2 is a cross-sectional view of a molecular-drag vacuum pump in one embodiment taken along line 2—2 in FIGS. 5 and 6.
Figure 3:
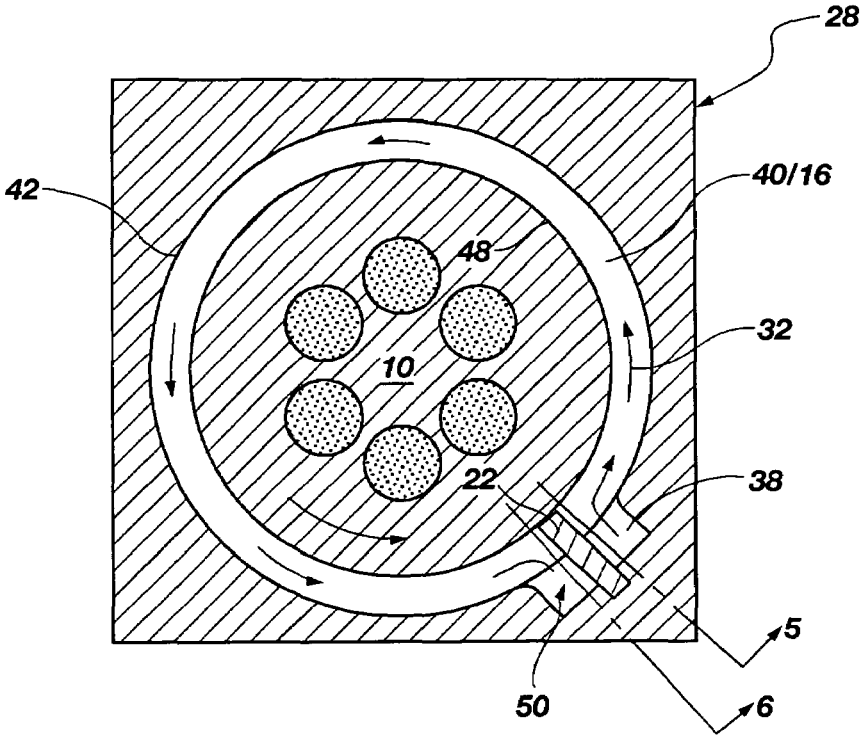
FIG. 3 is a cross-sectional view taken along line 3—3 in FIGS. 5 and 6.
Figure 4:
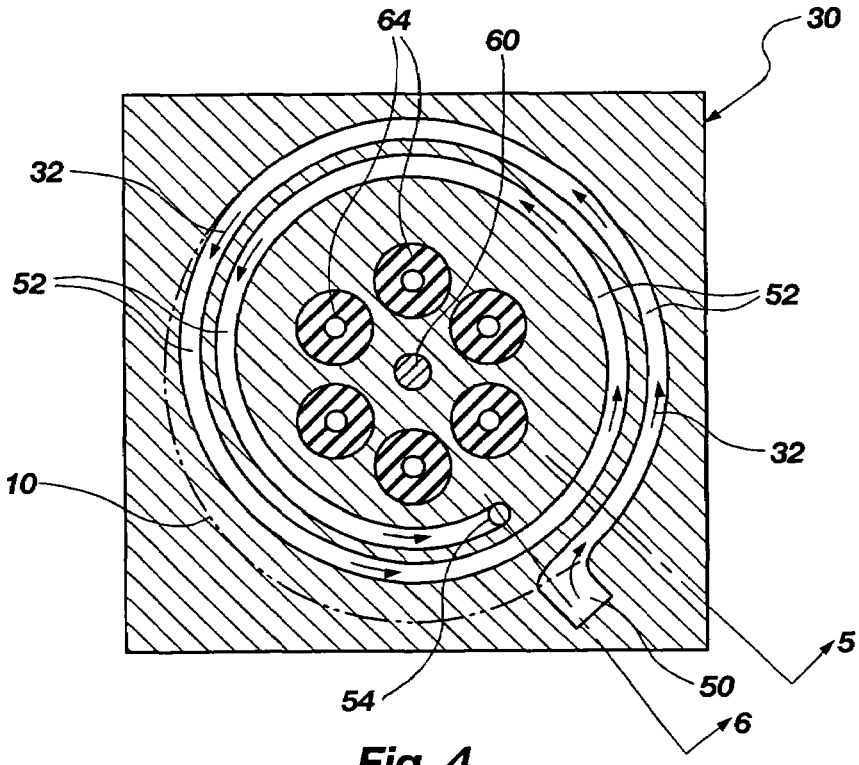
FIG. 4 is a cross-sectional view taken along line 4—4 in FIGS. 5 and 6.

The rotor 10 is contained within a housing 24 (FIGS. 5 & 6) comprising an inlet cover 26, a spacer 28, and an outlet cover 30. FIGS. 2, 3, and 4 provide horizontal cross-sectional views of the inlet cover, spacer, and outlet cover, respectively. In operation, gas flow, indicated by arrows 32 (FIG. 1) enters through the inlet 34 (FIG. 2) into a first annular passageway 36 formed in the inlet cover. The bottom of the first passageway 36 is formed by the top surface 12 of the rotor. When the rotor is spinning, exchange of momentum between the top surface of the rotor and the gas stream causes the gas stream to accelerate around the first passageway toward the first wiper plate 20, increasing the average kinetic energy of the gas stream in the direction of rotation of the rotor. The increase of energy in a single direction naturally increases the pressure of the gas, as described in the above references, which explain the theory and principles of operation of molecular-drag pumps.

As the gas stream 32 continues around the first passageway 36, it approaches the first wiper plate 20, which directs the flow radially outwardly past the edge of the rotor 10, and into a first vertical tube 38, and downward to a second passageway 40. The circuit of the gas from the inlet to the first wiper plate is the first stage of compression. Shown in FIG. 5 is a partial cross-sectional view taken near the location of the first wiper plate 20, showing the wiper plate, the first passageway, the first vertical tube 38, and the second passageway adjacent to the rotor.

Figure 5:
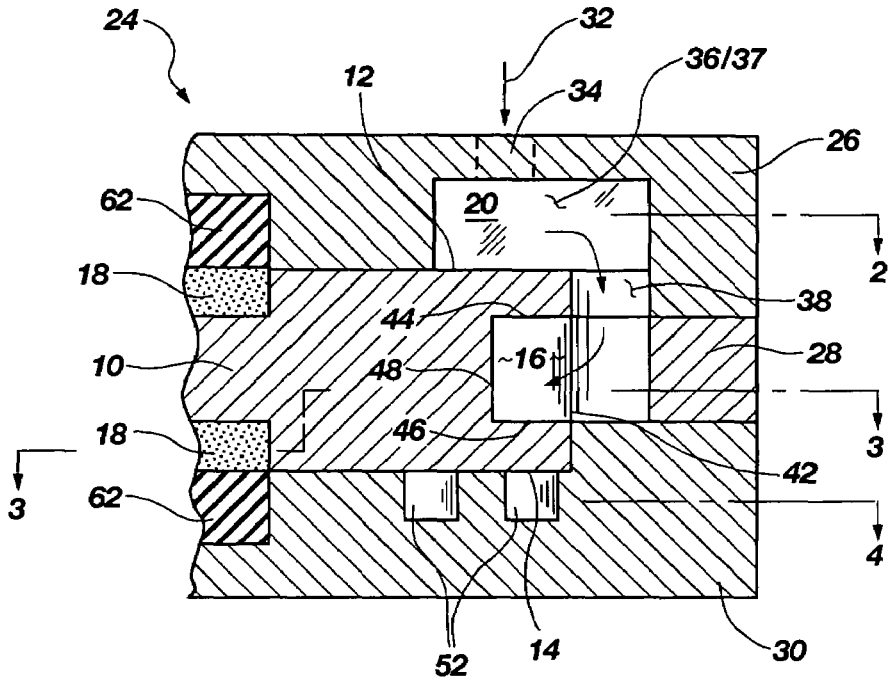
FIG. 5 is a cross-sectional view of a molecular-drag vacuum pump in one embodiment taken along line 5—5 in FIGS. 2–4.

Advantageously, the embodiment of FIGS. 2 and 5 includes a leak redirection path. Naturally, there will be a small gap between the surface of the first wiper plate 20 and the top surface 12 of the spinning rotor 10, which will allow some small fraction of the gas stream to leak therethrough. However, the present invention is advantageously provided with an auxiliary inlet 35 and auxiliary channel 37, which capture this leakage. When leakage gas passes under the first wiper plate, it enters the auxiliary inlet on the opposite side thereof, and is directed into the auxiliary channel. The auxiliary channel is parallel to and outside of first passageway 36, but is smaller in size. For example, in one embodiment of the invention, first passageway 36 is approximately 5 mm wide and 3 mm deep, while auxiliary channel 37 is 1 mm wide and 3 mm deep. A wall separates the first passageway 36 from the auxiliary channel 37, but that wall ends just before the first wiper plate, allowing the leaked gas in the auxiliary channel to be directed into first vertical tube 38 and on to the subsequent compression stages.

The provision of the auxiliary channel 37 provides at least two distinct advantages. First, leakage is not lost, but is returned to the gas stream 32 via the auxiliary channel. This allows leakage gas to be captured and compressed. Second, any gas leakage which is not initially redirected by the first wiper plate 20 will nevertheless be compressed some amount more than the gas which enters the inlet 34. Thus, when the gas stream within the auxiliary channel exits that channel and merges with the primary gas stream near the wiper plate, it will complement the total stream, creating a higher average pressure at the end of the first stage.

The molecular drag pump of the present invention can also operate without the auxiliary passageway. Viewing FIGS. 7 and 8, the top cover 126 may include only a first passageway 136, with no auxiliary channel. Any leakage past the first wiper plate 120 will tend to flow through the small gap between the rotor and the wiper plate until it reaches the inlet 134. There, this leakage gas will combine with the incoming gas and add to the incoming flow, thereby increasing fluid pressure at the inlet. The inventors have found that improvements in the configuration and operation of the wiper plates can also significantly reduce the amount of leakage around the wiper plates.

Referring back to FIGS. 3 and 6, the second passageway 40 is located within the channel 16 in the edge of the rotor 10, and against the inside wall 42 of the spacer 28. Because it is located within the channel 16, the second passageway is bounded by only one stationary surface, the inside wall of the spacer, and three moving surfaces: the top 44, bottom 46, and back 48 of the channel (FIGS. 1 & 5). By virtue of this configuration, the second channel imparts more kinetic energy per unit volume to the gas stream 32 than other drag pump designs, which typically comprise channels formed in the housing, such that there is only one moving surface and three stationary surfaces. It will be apparent that the channel 16 need not be rectangular in shape, but may be formed with more or less than three sides, with curved sides, or in any desired configuration that creates a passageway against the spacer wall having more moving surface area than stationary surface area.

Like the first passageway 36, the second passageway 40 is also annular in configuration, and directs the gas stream against the inside wall 42 of the spacer 28, around the perimeter of the rotor 10 toward the second wiper plate 22. The circuit of the gas from the first vertical tube 38, around the channel 16 to the second wiper plate is the second stage of compression.

Figure 6:
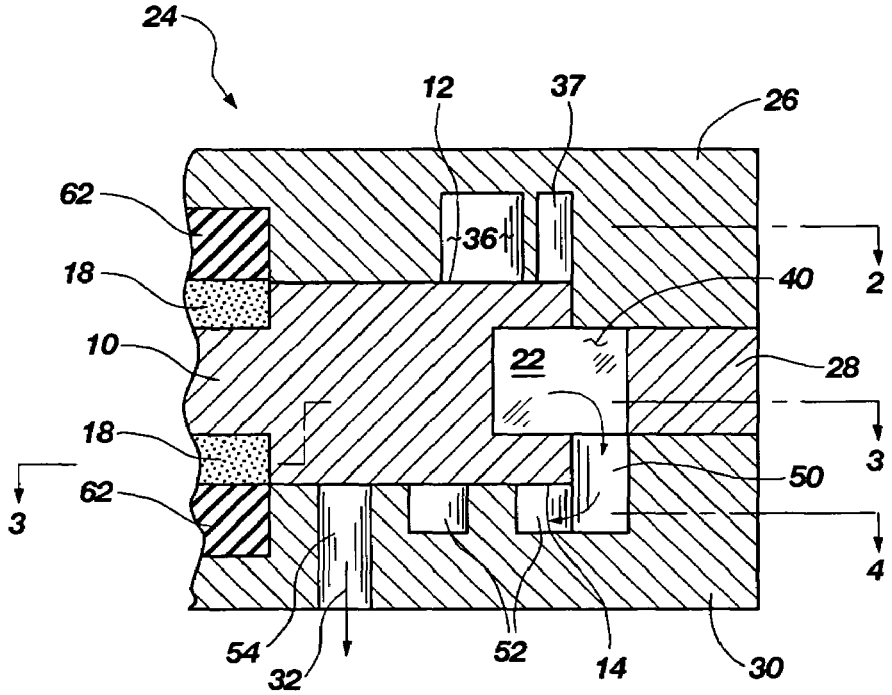
FIG. 6 is a cross-sectional view taken alone line 6—6 in FIGS. 2–4.

As with the first wiper plate 20, the second wiper plate 22 directs the gas stream radially outwardly past the edge of the rotor 10, into a second vertical tube 50, and into the third passageway 52 formed in the outlet cover 30. Shown in FIG. 6 is a cross-sectional view of the second wiper plate, the second passageway 40, the second vertical tube, and the third passageway. Like the first wiper plate, any leakage around the second wiper plate naturally flows back into the second passageway so as to "prime" the flow entering therein and further avoid loss of compressed gas in the manner described above.

The third passageway 52, similar to the first passageway 36, is formed to be adjacent to the bottom surface 14 of the rotor, thereby providing a third stage of compression of the gas stream 32. However, unlike the first or second passageways, the third passageway does not merely describe one circuit of the rotor, but is preferably formed in a spiral configuration as shown in FIG. 4, and figuratively represented in FIG. 1. The spiral may describe two, three, or more inwardly spiraling circuits around the central axis of the rotor 10. Each additional circuit of the circular path imparts more kinetic energy to the gas stream, resulting in increased pressure. As shown in FIG. 4, the third passageway may be a spiral describing two circuits around the center of the rotor 10. However, the spiral path may describe fewer or more circuits than this number. The compressed gas stream then exits through the outlet 54.

By virtue of its three-stage design, the present molecular-drag pump imparts more kinetic energy to the gas stream for a given rotational speed than conventional disk-type molecular-drag pumps, and is thus able to obtain higher compression of the gas stream with less energy. Compression is also enhanced by the slotted rotor design, which provides more surface area of contact between the rotor and the gas stream. Though shown with only one channel 16, it will be apparent that the rotor 10 could be provided with more than one channel to provide additional compression stages. Additionally, a drag pump could be configured with more than one rotor, possibly rotating at different speeds, to provide for more stages of compression as another modification.

Several other advantageous design features also contribute to the effective functioning of this invention. As shown in FIG. 1, the rotor 10 includes a bearing hub 56 disposed in its center. Rather than providing oil lubricated bearings or expensive air bearings which require very precise fabrication tolerances and which are also very difficult to physically isolate from the vacuum chamber and pumping channels, the bearing hub is a simple cylindrical axle which fits into corresponding cylindrical holes 58 and 60 formed in the center of the inlet cover 26 and the outlet cover 30, respectively. To provide for the rapid rotation of the axle within the holes, the axle utilizes a low friction, low wear solid lubricated carbon coating. A suitable carbon coating of this type is a diamond-like low wear carbon coating manufactured by Argonne National Laboratory of Argonne, Ill. This solid lubricated coating allows a very simple rotating bearing to provide reliable support for the rotor at the high speeds required, with very little wear.

Also of great value to the present invention is the motor design. It will be apparent to one skilled in the art that many drive motor configurations could be provided to impart the necessary rotation to rotor 10. For example, a high speed electrical motor could be connected to the bearing hub 56 to cause the rotor to spin. However, the molecular drag pump of the present invention is intended to be ambulatory, such as for carrying by a combat soldier for periodic atmospheric sampling to check for the presence of dangerous chemical or biological agents. Consequently, the pump and its power source are preferably very small and lightweight. Additionally, to operate at the very high rotational speeds indicated above, the pump must be very well balanced and free of vibration. The motor design associated with the pump of the present invention is intended to provide these advantages. It provides a very lightweight, compact, pancake-shape pump with minimum vibration and power consumption.

The compact molecular-drag pump disclosed herein advantageously comprises an integrated slotless, brushless, permanent magnet motor. One embodiment of this motor is depicted in connection with the pump of FIGS. 1–6. As noted above, disposed around the center of the top surface 12 and bottom surface 14 of the rotor 10 are a circle of permanent magnets 18. The rotor and pump housing 24 are preferably formed of aluminum. Aluminum is desirable because it is strong and lightweight, it will not interfere with the operation of the electromagnetic components of the motor, and it does not present the potential outgassing problems that other materials such as polymers might present. The term outgassing refers to the gradual release of trace amounts of gasses trapped in or on the surface of a substance, particularly when the substance is exposed to low pressures. Outgassing materials present the potential for contaminating the gas stream in the pump, which would reduce accuracy when the pump is used in compact ambulatory systems, such as a portable mass spectrograph-based chemical and biological detector.

To further reduce the likelihood of outgassing, the aluminum rotor and housing can be baked to help release as much trace gas as possible before the pump is used for a given application. Before the pump is first used, and after subsequent uses, the pump should be baked for about 5–10 hours (with the pump running) to eliminate the effects of previous exposure to atmospheric gasses and vapor. Small quantities of gas and vapor can be trapped on the metal surfaces, and then later contaminate the gas stream when the pump is used for sampling, testing, etc. Advantageously, aluminum can be effectively baked at a temperature at or below about 100° C. Other materials require much higher temperatures to effictively reduce outgassing. For example, stainless steel requires a baking temperature of 500–600° C.

In one embodiment of the motor, the permanent magnets are arranged to lie opposite a circle of electric coils 62 and 64, disposed about the center of the inside of the inlet cover 26, and outlet cover 30, respectively. Electric current provided to the coils 62 and 64 interacts with the permanent magnets, causing the rotor to turn in the same manner as the rotor of a brushless permanent magnet motor. The inventors have found that the pump and motor configured in this manner are capable of pumping 500 cc/sec., with a compression ratio of 1000, while consuming only 5 watts of power.

Though two sets of magnets 18 and coils 62 and 64 are shown and/or described, it will be apparent that the pump could be provided with a single set of magnets and coils and still meet the requirements of this invention. Nevertheless, the inventors prefer to have two sets of coils for reasons explained below. Control and switching for the integrated motor components are provided by external circuitry, rather than mechanically through contact with the rotor. This helps reduce friction with the rotor, thereby further reducing power consumption and contributing to longer operating life for the system. Those skilled in the art of electric motors will recognize that there are many ways a motor of this design can be electronically controlled to provide the desired rotation.

Another embodiment of a molecular drag pump 100 and integrated motor is illustrated in FIGS. 7–10. Viewing FIGS. 7 and 8, like the embodiment described previously, this pump includes an inlet cover 126, an outlet cover 130, and a spacer 128, which surround a rotatable disk or rotor 110. An inlet 134 leads to a plurality of gas passageways or pumping channels, including a first pumping channel 136, which is disposed adjacent to the top of the rotor. A first wiper plate 120 is disposed against the top of the rotor at the end of the first pumping channel, and redirects the gas flow through a vertical tube 138 into a second pumping channel 140 disposed against an edge of the rotor. At the end of the second pumping channel, the gas flow is directed by another wiper plate (not shown in FIGS. 7–10) into a third pumping channel 152 that has a spiral configuration. From that point the compressed gas stream exits through the outlet 154.

Advantageously, the inventors have developed a compact integrated axial flux motor which provides the desired flat shape, provides high starting torque, low power losses, low vibrations, and low rotor bearing loads. In the embodiment of FIGS. 7–10, a circle of permanent magnets 118 is disposed in the rotor 110, as with the previous embodiment. Viewing FIGS. 10A and 10B, the circle of discrete magnets 118 is used to emulate the characteristics of a two-pole pair cylindrical magnet 200, while ensuring structural integrity of the rotor 110. The magnet size and spacing is adjusted to produce a back emf profile that is similar to that obtained using a ring magnet with two pole-pairs, as found in conventional DC motors. The use of small discrete magnets reduces cost, and promotes structural integrity of the rotor. At very high rotational speeds, such as used in the molecular-drag pump of the present invention, the stresses in the rotor are very large (as a result of large centrifugal forces). A solid cylindrical magnet would not only increase fabrication costs, but would also increase the mass of the rotor, and thus introduce higher centrifugal forces. This particular magnet configuration also helps minimize switching losses associated with field collapse in the drive coils, as will be explained in more detail below.

It will be apparent that where rotational speeds of 100,000 to 200,000 rpm are contemplated, switching losses can become very significant. As is well known, transients in electric coils must dissipate each time the direction of current is switched. Thus, reduction in the frequency of current switching can significantly reduce the power lost through these transients, and also reduce resistive losses associated with field collapse in the drive coils when current is switched. The motor design depicted in FIGS. 7–10 provides a three-phase, two-pole pair motor that significantly reduces switching losses. Rather than using six cylindrical electric coils arranged in a circle (as in FIGS. 2 and 4) the improved integral motor comprises three D-shaped coils 162 arranged in a circle around the center of the top cover 126, as shown in the plan view of FIG. 7. Similar coils 164 of the same design and configuration are also provided in the bottom cover 130. As will be appreciated by those skilled in the art, the direction of current in the coils, represented by arrows 202, in combination with the polarity of the adjacent permanent magnet at any given time, provides the electromagnetic force that drives the motor.

Figure 7:
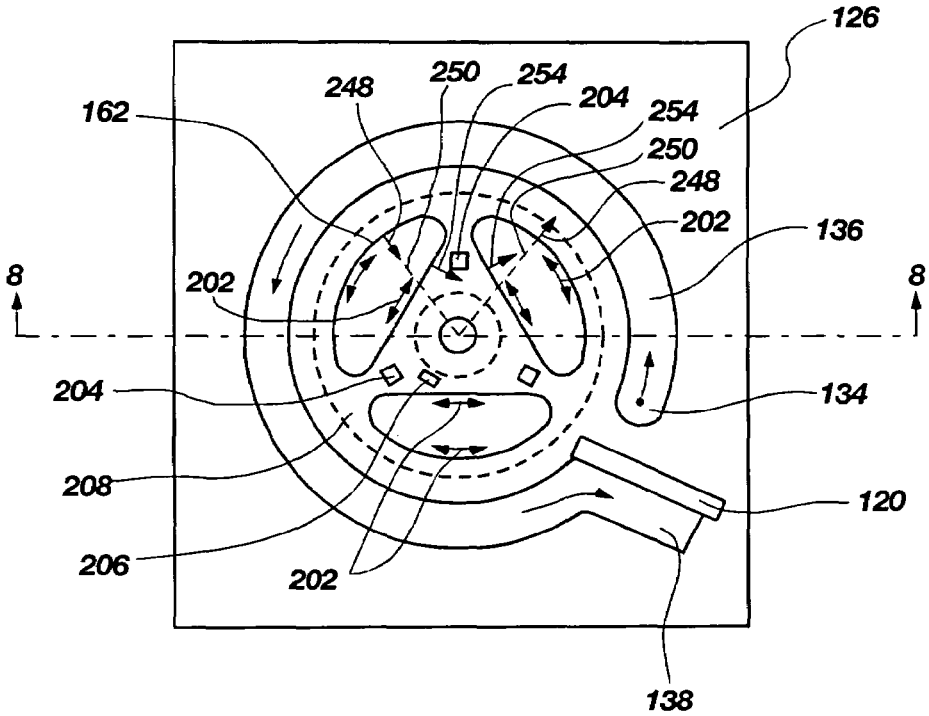
FIG. 7 is a reflected view of the top cover of an alternative embodiment of a molecular drag pump having a three phase integrated motor.

The D-shaped coil configuration is particularly advantageous. As shown in FIG. 7, because of their unique shape, the coils 162 produce two types of force vectors. The exterior curved portion of the coils produce a radial force vector 248 in the plane of rotation of the rotor that passes through the axis of rotation of the shaft 156 (the force line represented by dashed line 250). Because it passes through the axis of rotation, this force vector has no net effect on the rotation of the rotor. However, the interior straight portion of the coils produce a tangential electromagnetic force vector 254 that is in the plane of rotation and acts substantially tangential to the axis of rotation. Such force vectors from adjacent coils with current traveling in the same direction combine to provide a net tangential force to rotate the rotor.

The use of three electric coils 162, 164, provides a three-phase motor. The combination of the two-pole pair permanent magnet configuration (shown in FIGS. 10A and 10B) with the three phase coil configuration (shown in FIG. 7) allows the use of a six-step electronic switching methodology. That is, for each rotation of the rotor 110, current in the various coil pairs must be switched only six times. This greatly reduces switching losses when compared with other coil and magnet system configurations, such as that of FIGS. 1–6, which require a higher switching frequency. Switching is electronically controlled by an external electronic circuit (not shown) including an H-bridge circuit, though other circuits can be used.

Providing drive coils 162, 164 on both sides of the rotor 110 helps reduce power dissipation losses. As is well known to those skilled in the art, resistive losses are proportional to the square of the current. Thus, one coil with a given current will experience twice the power dissipation than two coils each with half the current. However, the same torque will be developed. Thus, two sets of coils will produce approximately half the power dissipation losses for a given total operating torque.

Disposed between adjacent coils 162 are Hall Effect sensors 204 that detect the change in magnetic field due to the permanent magnets 118, and provide this information to the electronic control and commutator circuit. This allows detection of the position of the permanent magnets relative to the drive coils, and provides sensing required to control the direction and speed of rotation of the rotor 110. At start-up, the motor initially turns the rotor slightly to allow the Hall Effect sensors to detect its position and direction of rotation. Based on this information, the controller can then initiate current flow in the proper coils in the proper direction to turn the rotor in the desired direction. Obviously, the pump will not function if the rotor turns in the wrong direction.

Other sensors could also be provided within the motor. For example, a temperature sensor 206 could be provided near the coils 162 to sense motor temperature and allow shut-down if the motor becomes too hot. One or more pressure sensors (not shown) could also be placed in various locations within the gas passageways of the pump to allow monitoring of its opertion.

The integrated motor of FIGS. 7–10 is a slotless configuration, which helps to reduce vibration. In conventional brushless permanent magnet motors, the electric drive coils are typically wrapped in slots in a soft iron core that is common to all coils. This slotted design produces localized regions of increased magnetic attraction between the permanent magnets and the iron core. When such a motor is unpowered, for example, the rotor will have a preferred position of rest, which aligns with these localized magnetic regions. This configuration causes vibration when the motor is in operation, because the spinning rotor is continually passing through and past its desired rest position.

In the present drive motor, in contrast, the coils 162, 164 do not rest in slots fabricated in the magnetic flux return path core material, though they may be encased in a non-ferromagnetic, low-outgassing material. Instead, the motor is provided with soft ferrite rings 208 disposed adjacent to each set of coils. The ferrite rings are shown in plan view (in dashed lines) in FIG. 7, and in cross-section in FIG. 8. Because there is no slot in the ferrite rings (i.e. they have a uniform cross-section), the magnetic attraction between the permanent magnets 118 and the ferrite rings is constant regardless of the orientation of the rotor 110, thereby reducing vibration. That is one advantage of the slotless motor design.

The ferrite rings 208 provide a flux return path for the magnetic flux created by the permanent magnets 118 and the drive coils 162, 164. Magnetic flux will naturally tend to flow through nearby materials that have high magnetic permeability, such as the ferrite rings, rather than flowing in the aluminum housing or free space. It is well known that the provision of soft magnetic material with large magnetic permeability in the proper geometric configuration adjacent to electric coils and permanent magnets can direct and channel the magnetic flux in a desired way. Iron and other ferromagnetic materials can also be used as a magnetic flux return path. In a conventional brushless permanent magnet motor, the common iron core materials provide a flux return path that directs magnetic flux more directly to the opposite pole. This has the effect of increasing the magnetic field density in the air gap (230 in FIG. 8) between the coils and the rotor.

The soft ferrite rings 208 of the present invention provide the flux return path for the present motor. The inventors have found that this design is very efficient. Through experimentation and measurement, the inventors have found that only a very small fraction of the magnetic field extends beyond the ferrite rings. Consequently, a greater portion of magnetic field is directed toward production of torque by the motor, rather than being wasted in space.

Eddy current-related power losses are also a significant factor in this type of motor. Motion of the permanent magnets 118 induces a voltage in the soft magnetic material core (or in the ferrite rings 208) because of the time-varying magnetic field. This voltage creates eddy currents that consume power in proportion to the square of the induced voltage, and inversely proportional to the electrical resistivity of the core material. Soft iron core materials experience relatively high power losses due to eddy currents when the magnetic field changes at a high rate. Iron has relatively low electrical resistivity, which results in relatively large induced eddy current losses. One well known technique for minimizing eddy current-related power losses is to construct the core in a laminated configuration, with alternating layers of iron separated by a thin electrical insulating material. The reduced thickness of any one layer of iron reduces the power lost to eddy currents. However, the inventors have found it impractical to use a laminated material for the flux return path of the present motor. A laminated core would have eddy current losses that are too large for practical use in a pump of this configuration where the rotor must spin at approximately 100,000 to 200,000 rpm, and where power consumption must be minimized.

Instead, because eddy current-related power losses are inversely proportional to the electrical resistivity of the material, another approach to reducing power losses is to use a material with a higher resistivity. In the present invention, soft ferrite is used for the flux return rings 208 because it has a much higher resistivity than iron. The soft ferrite material also has low magnetization losses (having a narrow hysteresis loop), and exhibits high magnetic permeability, as well as a relatively large saturation magnetization. Consequently, the soft ferrite rings provide an effective flux return path that increases the magnetic field density between the coils and the rotor, and also reduces eddy current and magnetization reversal-related power losses. This configuration also has the benefit of reducing heating of the coils, which improves the operation and longevity of the motor.

Figure 8:
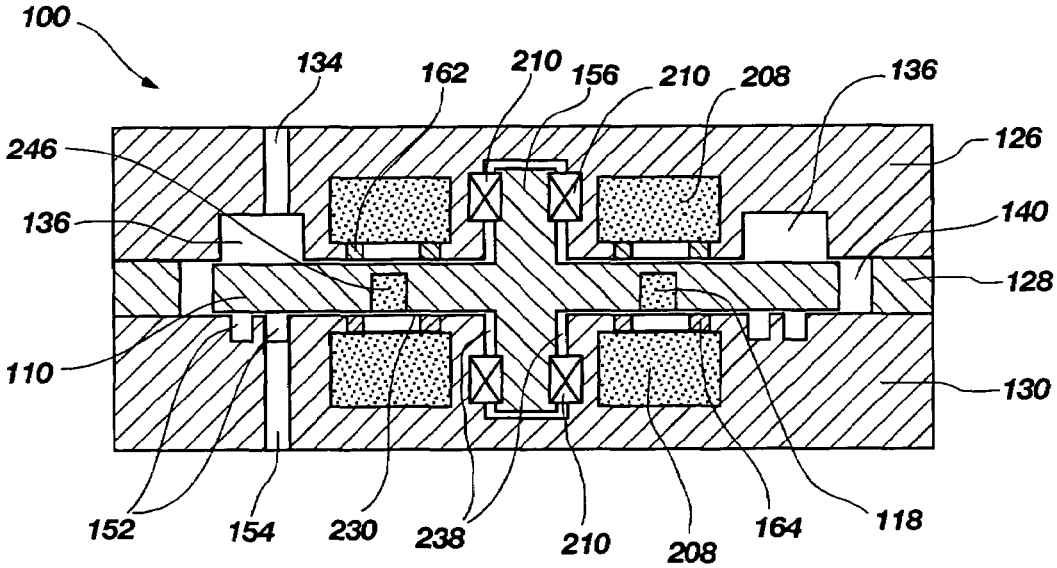
FIG. 8 is a cross-sectional view of a complete molecular-drag vacuum pump having an integrated two-pole pair three phase axial flux motor.

The motor depicted in FIG. 8 includes fluid lubricated bearings 210 (using a fluid with a low vapor pressure) associated with the rotor shaft 156. Advantageously, the motor design described above imposes low loads on the bearings. The soft ferrite rings 208 are disposed symmetrically with respect to the plane of the rotor magnets 118, so as to balance the attractive magnetic forces on opposing sides of the rotor 110 and reduce stress on the rotor shaft bearings. By disposing the permanent magnets substantially equidistant from each of the soft ferrite magnetic flux return rings, the magnetic attraction force between the top soft ferrite ring and the spinning rotor 10 is almost balanced by the attraction force between the magnets and the bottom soft ferrite ring 208. This configuration reduces axial loads on the bearings, which is beneficial for long operation life without maintenance, and low power consumption.

The molecular-drag pump of the present invention is highly modular. Viewing FIG. 8, the alignment of the inlet 134 and outlet 154 passageways is such that an array of similar pumps 100 may be connected in series (i.e., the inlet of the second pump coupled to the outlet of the first). Individual pump modules thus comprise building blocks with a relatively flat shape from which a larger pumping system may be created by stacking the pumps one atop the other. Two molecular-drag pumps may be built separately, and then interconnected in series to achieve a higher overall compression ratio.

If two motorized pumps 100 are connected in series, they may be configured to counter-rotate under their own power, thus reducing gyroscopic loads on the operator. Gyroscopic loading on the operator is minimized because the rotor of the first pump spins in one direction, while that of the second pump spins at substantially the same speed in the opposite direction, about a common rotational axis. When used in compact ambulatory systems, such as a portable mass spectrograph-based chemical and biological detector, it is desirable that low load be applied on the operator while manipulating and moving the instrument. The compact size and modularity of the molecular-drag pump assembly of the present invention is very useful for this purpose.

Figure 9:
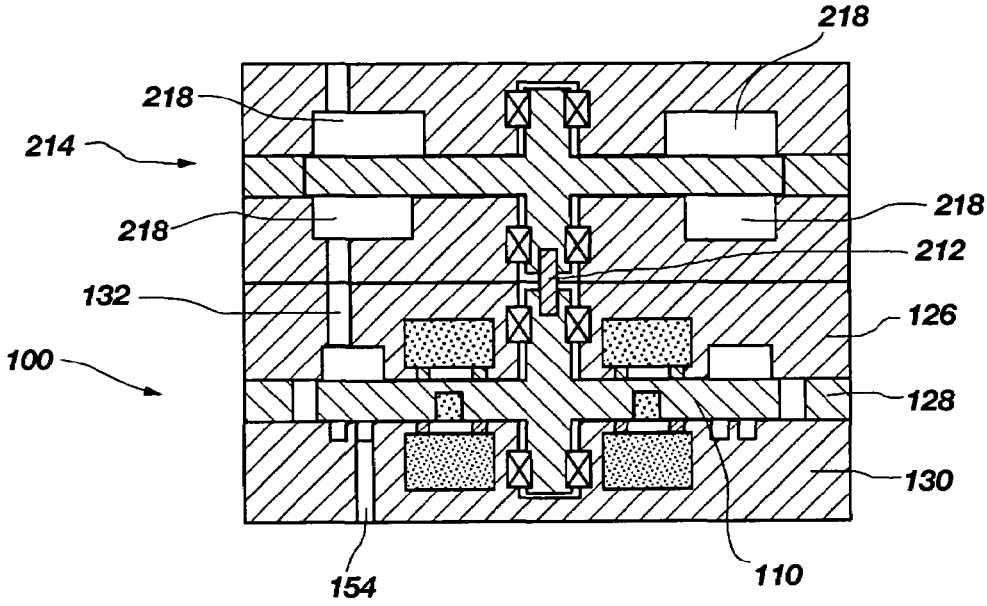
FIG. 9 is a cross-sectional view of a molecular drag pump module as in FIG. 8, coupled in series with a non-motorized molecular drag pump module.
Figure 10A:
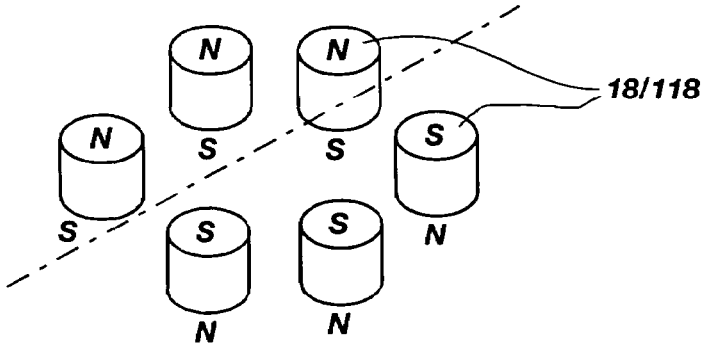
FIGS. 10A and 10B are pictorial diagrams illustrating how the array of discrete permanent magnets in the rotor emulates the characteristics of a two-pole pair cylindrical magnet.
Figure 10B:
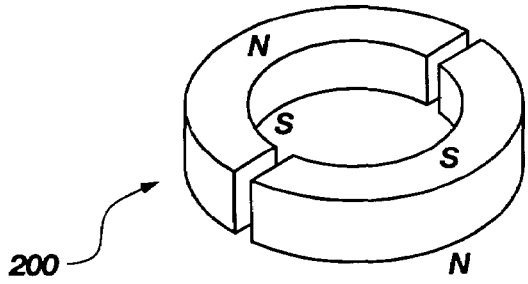

Alternatively, serial pumps may share a common motor, as depicted in FIG. 9. In the embodiment a self aligning low friction mechanical coupling 212 is used to connect a powered pump module 100 to an unpowered module 214. The two modules are thus powered by the motor of the first module. A self-aligning (laterally and vertically sliding) magnetic coupling (not shown) may also be used, rather than the direct mechanical coupling shown in FIG. 9. The first unpowered stage pump 214 includes only the rotor 110 and housing 124 with pumping passageways 218, and includes no motor components. As shown, the unpowered module may have pumping passageways that are configured differently from those of the powered module, though still operating under the same principles.

Figure 11:
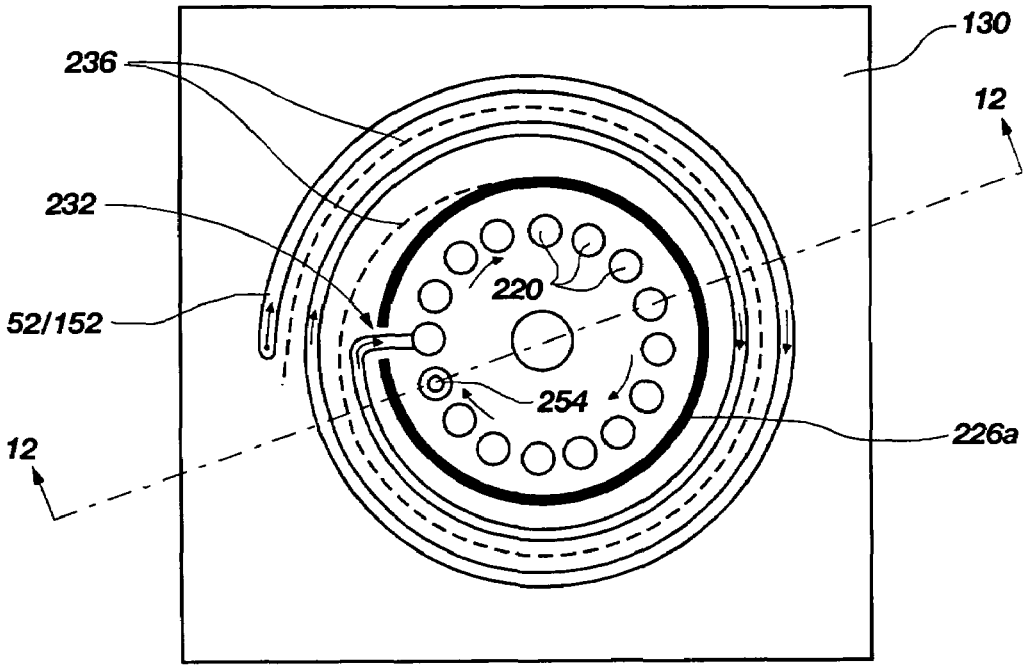
FIG. 11 is a top view of the bottom cover of a molecular drag pump having a spiral channel connected in series with a ring of regenerative pumping pockets.
Figure 12:
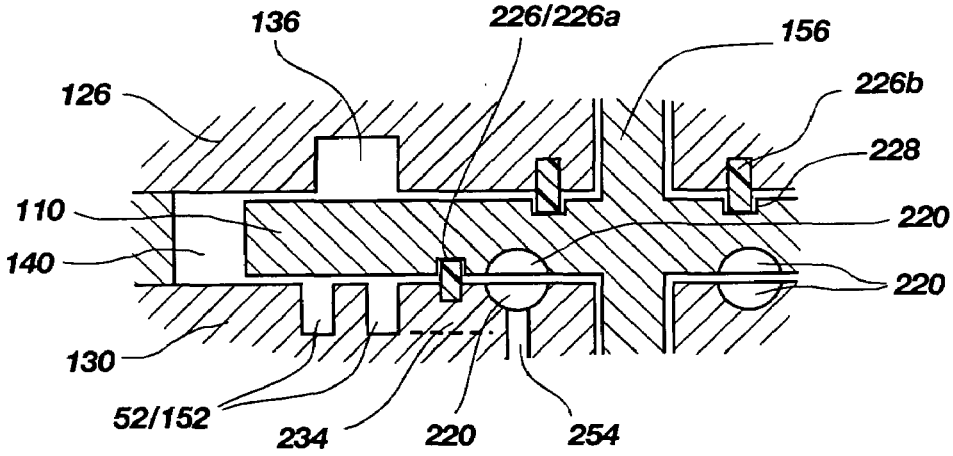
FIG. 12 is a partial cross-sectional view of a molecular drag pump having the bottom cover of FIG. 11, showing the regenerative pumping pockets formed in the stator and in the rotor.

Referring to FIGS. 8 and 11–12 backflow in the spiral or high pressure channel 152 near the outlet of the pump may be reduced by employing the general concept of the regenerative pump (see, e.g. German Patent No. 3,919,529, Jan. 18, 1990). Referring to FIGS. 11 and 12, there is shown one embodiment of a compact molecular drag vacuum pump equipped with regenerative pumping features. The regenerative pump comprises small regenerative pockets 220 fabricated in the rotor 110 and housing 124 on the side of the spiral channel 152. These pockets are disposed between the end of the spiral channel and the outlet to help prevent backflow in the spiral channel through regenerative pumping action. The spiral channel and the regenerative pump are fabricated in the same plane to obtain a very compact pump.

Regardless of the configuration of the motor, it is desirable to reduce or eliminate gas leaks between pumping paths in the molecular drag pump. Furthermore it is desirable to reduce or eliminate virtual leaks (gas traps), particularly in the high vacuum part of the pump. The present invention employs several techniques for reducing gas leaks between pumping paths.

One feature of the compact molucular drag pump that reduces gas leaks is the configuration of the wiper plates. In order to achieve the desired compression ratios in a compact package, the seal between the wiper plates 20, 22, 120 and the rotor 10, 110 needs to be very good, and passive leaks between adjacent channels or passageways must also be minimized. The first and second wiper plates are configured as a self-sealing vane, formed of a conformable plastic material such as Ultem plastic, manufactured by A.L. Hyde Company, Inc. of Greenloch, N.J. When the pump is first assembled, the wiper plates directly contact the surface of the rotor. As the rotor rotates in its early operation, the plastic material of the wiper plates naturally abrades and conforms to match the exact size and shape of the opening it is to fill. Once deformed as required, the wiper will form a tight seal against the rotor, while creating very little friction. So long as the wiper plate adequately fills the space against the rotor and within the respective passageway, it will redirect the flow of gas as needed with very little leakage. However, there will still be a slight gap between the wiper plate and the rotor. As noted, the present invention advantageously directs any leakage which may occur around the wiper plates, back into other passageways, thereby imparting its kinetic energy to the incoming stream to "prime" the incoming gas flow.

Where an integrated motor is used, however, the process of matching the parts through abrasion may not be very practical because of the small torque developed by the motor. Furthermore if the rotor 10, 110 touches the housing 24, 124 during operation (especially in ambulatory or portable systems) it slows down rapidly, and may even stall.

Referring to FIG. 13, the inventors have found that by forming small ridges 222 (either machined, molded, or formed by other methods) on the facing surface 224 of the wiper plates 20, 22, 120, wear is substantially accelerated with less frictional resistance to rotation of the rotor 10, 110. Fabrication is also simplified because contact between the rotor and the wiper plates upon initial assembly has minimal impact on the performance of the pump because there is less contact area. The wiper plate and ridges shown in FIG. 13 are both greatly exaggerated in size for purposes of illustration. And, while the wiper plate shown in FIG. 13 is depicted adjacent an edge of a spinning rotor, it will be apparent that the concept applies to all wiper plates that may be adjacent to any moving surface.

The ridges 222 on the wiper plates may comprise sharp triangular ridges as shown, or other shapes, such as rounded ridges (similar to a corrugated shape), squared ridges, etc. These ridges are smoothed or worn down during initial operation of the rotor, or upon collision between the rotor and the wiper plates. This is facilitated by the material of the wiper plates, being a soft material such as PTFE, Ultem plastic or other suitable material. A low outgassing material is preferred in order to prevent the introduction of contaminant gasses into the gas stream.

As depicted in FIG. 13, the ridges 222 are oriented normal to the direction of motion of the adjacent rotor surface in order to provide a tight seal between the rotor and the wiper in a direction perpendicular to the direction of the gas stream. Because the wipers initially place a relatively small surface area against the rotor (i.e. just the tops of the ridges), they provide low resistance to rotation of the rotor while the wipers are being worn down to a conformable fit, producing only a very small gap between the rotor and the facing surface of the wiper.

Figure 14:
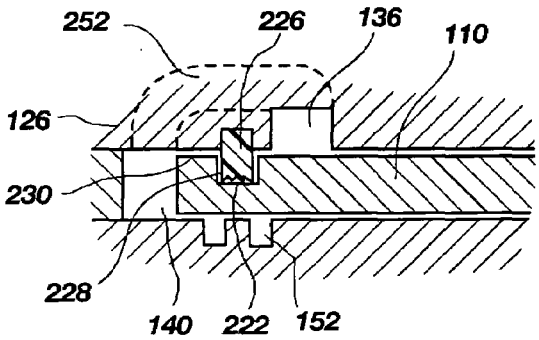
FIG. 14 is a partial cross-sectional view of a molecular-drag pump having a passive seal ring for reducing leak paths between adjacent pumping channels.
Figure 15:
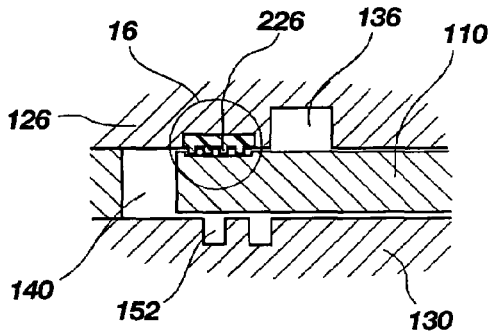
FIG. 15 is a partial cross-sectional view of a molecular-drag pump having a passive seal ring with an array of grooves and ridges that mate with corresponding grooves and ridges in the rotor.

It will be apparent that the seal between the wiper plates and the rotor is actually a pumping leak, because the thin gap between the wiper plate and the rotor acts as a molecular-drag pump itself. Referring to FIGS. 14–16, several additional methods can also be used to effectively reduce leaks between adjacent pumping channels while also maintaining moderate tolerances and relatively low fabrication cost. The essence of the approach is to reduce any direct line of sight by which a molecule could travel from a higher pressure channel to a lower pressure channel. One method for reducing such leaks is to provide a passive seal ring 226 disposed in a matching groove 228 formed in the rotor 110. As noted above, there is ordinarily a small gap 230 between the rotor and the adjacent stationary portions of the pump. This gap provides a potential leakage pathway between adjacent pumping passageways. Advantageously, the passive seal ring, affixed to the stationary portion of the pump (the top cover 126 in FIG. 14), is disposed between adjacent pumping channels 140 and 136, and extends into the corresponding groove in the rotor to block a potential leakage pathway. Seal rings may be disposed in various locations to prevent passive and active leakage.

As with the conformable wiper plates described above, the passive seal ring 226 is preferably made of a soft abradable plastic material such as PTFE or Ultem plastic, and is provided with ridges 222 in its contacting face in a similar manner as the wiper plate in FIG. 13. The ridges help reduce friction between the rotor and the seal ring during initial operation of the pump, until the facing surface becomes sufficiently abraded to provide a tight shape-conformed seal. Because the potential leakage pathway is generally perpendicular to the long axis of the passive seal ring, the ridges in its contacting surface are parallel to, rather than perpendicular to the direction of motion of the adjacent rotor surface, as shown in FIG. 14. This configuration further reduces the friction between the rotor and the passive seal ring during initial operation of the motor.

It will be apparent that to function as shown in FIG. 14, the passive seal ring 226 may be a closed ring, or may be a discontinuous ring having a gap or opening to allow for passageways that connect adjacent pumping passageways. For example, FIG. 11 depicts a discontinuous passive seal ring 226*a* disposed between the spiral pumping passageway 152 and the circle of regenerative pumping pockets 220 in the bottom cover 130 of the pump. This passive seal ring includes a gap 232 to accommodate the passageway 234 between the end of the spiral pumping passageway and the circle of regenerative pumping pockets. Alternatively, the passive seal ring in FIG. 11 could be configured as a spiral (represented by a dashed line 236) extending parallel to the spiral passageway from beginning to end. Indeed, the entire spiral channel could be formed by a single spiral seal ring 236 that is attached to the bottom cover, the region between adjacent portions of the spiral seal ring defining the spiral passageway.

Alternatively, the passive seal rings can be continuous, unbroken rings. For example, viewing FIG. 12, the passageway 234 between the end of the spiral channel and the regenerative pumping pockets 220 can be routed under the seal ring 226/226*a* therebetween. Additionally, a closed circular passive seal ring 226*b* may be disposed against the rotor 110 near the central shaft 156 to prevent passive leakage or a "gas trap" in the interior cavity (238 in FIG. 8) surrounding the shaft. Since no gas passageway needs to pass into the interior cavity, no break is needed in the seal ring.

In other locations, where gas passageways must traverse a seal ring, continuous seal rings may still be used if the gass passageway is routed around the seal ring. For example, viewing FIG. 14, a gas transfer passageway 252 (shown in dashed lines) can be provided around the seal ring 226 between the gas passageway 130 against the top of the rotor, and the passageway 140 against the side of the rotor. Other configurations for passive seal rings 226 are also possible.

Figure 16B:
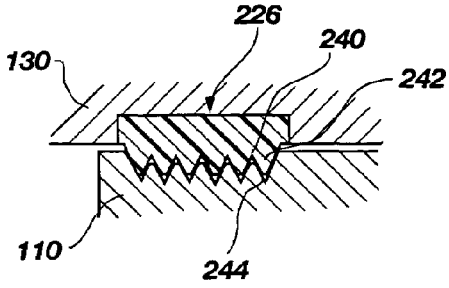
FIG. 16B is a close-up cross-sectional view of an alternative embodiment of the passive seal ring of FIG. 15.
Figure 16A:
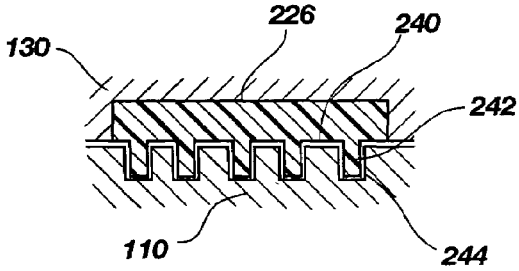
FIG. 16A is a close-up view of one embodiment of the passive seal ring of FIG. 15.

With regard to the ridges on the contacting face of the seal ring, viewing FIGS. 15–16B, rather than a single ring that fits into a single groove, the passive seal ring may include an array of grooves 240 and ridges 242 that are configured to fit into a corresponding array of grooves 244 in the rotor. As shown in FIG. 16A, these grooves and ridges may be rectangular in shape. Alternatively, as shown in FIG. 16B, the ridges 242 may be triangular in shape. Obviously, other shapes are also possible.

Another feature of this pump that helps reduce gas leaks is the configuration of the permanent magnets 118 installed in the rotor 110. These permanent magnets are disposed in small pockets 246 which do not extend entirely through the rotor. Consequently, there is no path by which gas can leak from the high pressure side to the low pressure side through the rotor around the magnets.

With this unique combination of a multiple stage drag pump, low friction bearings, and integral motor design, the inventors are thus able to produce a reliable, low cost, high efficiency molecular-drag pump that is powerful and efficient, and is suitable for a wide range of applications. It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A molecular drag vacuum pump, comprising:

a housing defining an inlet and an outlet;

a rotor rotatably carried within the housing;

a plurality of gas passageways, disposed in the housing between the inlet and the outlet and adjacent the rotor, configured to facilitate flow of a gas from the inlet to the outlet and to impart kinetic energy to the gas through contact of the gas with a moving surface of the rotor;

at least one wiper carried by the housing, configured to redirect flow of gas from one of the plurality of gas passageways to another of the plurality of gas passageways, the wiper having a facing surface configured to (1) contact a moving surface of the rotor upon initial operation of the pump, and (2) rapidly wear down so as to create a conformable fit between the facing surface and the moving rotor surface, the facing surface being formed with a plurality of parallel ridges so as to reduce friction with the rotor during said initial operation.

2. A molecular drag vacuum pump in accordance with claim 1, wherein the ridges are oriented substantially perpendicular to a direction of motion of the moving surface of the rotor.

3. A molecular drag vacuum pump in accordance with claim 1, wherein the ridges are substantially triangular in shape.

4. A molecular drag vacuum pump in accordance with claim 1, wherein the plurality of gas passageways comprises first, second, and third gas passageways, and the at least one wiper plate comprises:

a first wiper plate configured to redirect the flow of gas from the first passageway to the second passageway; and a second wiper plate configured to redirect the flow of gas from the second passageway to the third passageway.

5. A molecular-drag vacuum pump in accordance with claim 1, wherein the wiper comprises a low-outgassing polymer material selected so as to reduce introduction of contaminant gasses from the wiper into the flow of gas.

6. A molecular drag vacuum pump, comprising:

a housing defining an inlet and an outlet and configured to facilitate flow of a gas from the inlet to the outlet;

a rotor rotatably carried within the housing, the rotor including a first side, an edge side, and, a second side opposite the first side, and having an axis of rotation;

a first passageway in fluid communication with the inlet, said first passageway being disposed intermediate the housing and the first side, being defined by the housing and the first side;

a second passageway in fluid communication with the first passageway, said second passageway disposed intermediate the housing and the edge side, being defined by the housing and the edge side;

a third passageway in fluid communication with the second passageway, said third passageway disposed intermediate the housing and the second side, being defined by the housing and the second side;

a ring of regenerative pumping pockets, disposed intermediate the housing and the second side, in fluid communication with the third passageway and the outlet, configured to reduce backflow in the third passageway;

a first wiper carried by the housing, configured to redirect flow of gas from the first passageway to the second passageway; and a second wiper carried by the housing and configured to redirect flow of gas from the second passageway to the third passageway;

the gas being urged to enter the inlet and to rotate around the rotor axis at least one complete revolution before exiting the outlet.

7. A molecular-drag vacuum pump in accordance with claim 6, wherein the regenerative pumping pockets are disposed in a ring in the rotor, and an adjacent ring in the housing.

8. A molecular-drag vacuum pump in accordance with claim 7, wherein the regenerative pumping pockets comprise cavities with a substantially hemispherical shape.

9. A molecular drag vacuum pump, comprising:

a housing defining an inlet and an outlet;

a rotor rotatably carried within the housing, having a rotor axis, and a rotor shaft;

a plurality of gas passageways, disposed in the housing between the inlet and the outlet and adjacent the rotor, configured to facilitate flow of a gas from the inlet to the outlet and to impart kinetic energy to the gas through contact of the gas with a moving surface of the rotor;

at least one wiper carried by the housing, configured to redirect flow of gas from one of the plurality of gas passageways to another of the plurality of gas passageways; and a circular seal ring, concentrically disposed about the rotor axis, and attached to the housing adjacent a surface of the rotor, having a facing surface for creating a seal with the rotor, the seal ring configured to reduce leakage of gas between the housing and the rotor.

10. A molecular-drag vacuum pump in accordance with claim 9, wherein the seal ring is disposed between two of the plurality of passageways, and is configured to reduce leakage of gas between the two passageways.

11. A molecular-drag vacuum pump in accordance with claim 10, wherein the seal ring defines a boundary between the two passageways.

12. A molecular-drag vacuum pump in accordance with claim 10, wherein the two of the plurality of passageways comprise successive portions of a spiral passageway, and the seal ring defines a spiral configuration disposed therebetween.

13. A molecular-drag vacuum pump in accordance with claim 9, wherein the facing surface includes a plurality of parallel ridges configured to (1) contact a moving surface of the rotor upon initial operation of the pump, and (2) rapidly wear down so as to create a conformable fit between the facing surface and the moving rotor surface.

14. A molecular-drag vacuum pump in accordance with claim 13, wherein the ridges are oriented substantially parallel to a direction of motion of the rotor surface.

15. A molecular-drag vacuum pump in accordance with claim 13, wherein the ridges are configured in a shape selected from the group consisting of: (i) substantially triangular; and (ii) substantially squared.

16. A molecular-drag vacuum pump in accordance with claim 13, further comprising a cylindrical slot, disposed in a surface of the rotor, the seal ring extending into the cylindrical slot.

17. A molecular drag vacuum pump in accordance with claim 16, wherein the cylindrical slot comprises a plurality of concentric cylindrical slots, each of the plurality of cylindrical slots configured to receive one of the plurality of parallel ridges of the seal ring.

18. A molecular-drag vacuum pump in accordance with claim 9, wherein the seal ring comprises a discontinuous circular ring defining a gap therein, so as to accommodate a gas passageway interconnecting the two of the plurality of passageways.

19. A molecular drag vacuum pump in accordance with claim 9, wherein the seal ring comprises a continuous circular ring disposed against a surface of the rotor adjacent the rotor shaft.

20. A molecular drag vacuum pump in accordance with claim 9, wherein the facing surface of the seal ring comprises a low-outgassing polymer material selected so as to reduce introduction of contaminant gasses from the wiper into the flow of gas.

21. A molecular-drag vacuum pump in accordance with claim 9, further comprising a cylindrical slot, disposed in a surface of the rotor adjacent the housing, the seal ring extending into the cylindrical slot.

* * * * *

UNITED STATES PATENT AND TRADEMARK OFFICE

CERTIFICATE OF CORRECTION

PATENT NO. : 7,165,931 B2
APPLICATION NO. : 11/028998
DATED : January 23, 2007
INVENTOR(S) : Marc Olivier, Stephen C. Jacobsen and David F. Knutti It is certified that error appears in the above-identified patent and that said Letters Patent is hereby corrected as shown below:

Column 1, line 11, insert the following Government Interest statement:

--Statement of Government Rights
This invention was made with government support under DABT63-97-C-0066 awarded by DARPA Department of Defense Advanced Research Projects Agency. The government has certain rights in the invention.--

Signed and Sealed this
Twentieth Day of December, 2011

David J. Kappos
*Director of the United States Patent and Trademark Office*